United States Patent [19]

Takahashi et al.

[11] Patent Number: 4,661,171

[45] Date of Patent: Apr. 28, 1987

[54] METHOD FOR TREATING THE SURFACE OF STAINLESS STEEL BY HIGH TEMPERATURE OXIDATION

[75] Inventors: Haruji Takahashi; Shigeo Goto; Syuichi Takata; Mitsuaki Shibata, all of Kobe; Tomihira Hata, Kakogawa, all of Japan

[73] Assignee: Shinko-Pfaudler Company, Ltd., Kobe, Japan

[21] Appl. No.: 768,716

[22] Filed: Aug. 23, 1985

[30] Foreign Application Priority Data

Aug. 29, 1984 [JP] Japan ..... 59-181524
Feb. 12, 1985 [JP] Japan ..... 60-26083

[51] Int. Cl.[4] ..... C23C 8/18
[52] U.S. Cl. ..... 148/6.35
[58] Field of Search ..... 148/6.14 R, 6.35; 427/309; 204/34

[56] References Cited

U.S. PATENT DOCUMENTS

| | | | |
|---|---|---|---|
| 1,982,179 | 11/1934 | Scharscher | 148/6.35 |
| 2,978,361 | 3/1961 | Seidl | 148/6.35 |
| 3,125,471 | 3/1964 | Conner | 148/6.3 J |
| 3,437,532 | 4/1969 | Helgert | 148/6.35 |
| 3,556,871 | 1/1971 | Helgert | 148/6.35 |
| 3,968,313 | 7/1976 | Perlman | 148/6.14 R |
| 4,078,949 | 3/1978 | Boggs | 148/6.35 |

FOREIGN PATENT DOCUMENTS

A13135344 8/1982 Fed. Rep. of Germany .

OTHER PUBLICATIONS

J. Electrochemical Tech., Bombara, Apr. 1971, pp. 676–631.

Patent Abstracts of Japan, unexamined applications, C field, vol. 4, No. 173, Nov. 29, 1980, The Patent Office Japanese Govt., p. 58 C 32; Kokai No. 55–110 783 (Sumitomo Kinzoku Kogyo K.K.) relevant to claims 1–3.

*Primary Examiner*—Sam Silverberg
*Attorney, Agent, or Firm*—Marshall, O'Toole, Gerstein, Murray & Bicknell

[57] ABSTRACT

This disclosure is concerned with a method for treating a stainless steel surface by high temperature oxidation. The surface of a stainless steel article is cleaned. $TiO_2$ and $SiO_2$ are mixed in microparticles to form a coating agent, and water is added to the mixture to make a slip. The slip is coated on the steel surface to form a coating having a uniform thickness. The coating is dried and the article is subjected to a heat-treatment to form an oxide film. This treatment is performed in an oxidizing atmosphere for a time and a temperature suitable for the color tone to be produced. A desirable temperature for the heat-treatment is between 350° C. to 700° C. When a coating agent is used, it is later removed by washing, etc. after cooling the article.

Further, when less dissolution of iron from the stainless steel surface is required, a decolorization treatment is applied; that is, the colored oxide film is removed from the surface by dissolution using an acid or an electrolytic treatment.

2 Claims, 1 Drawing Figure

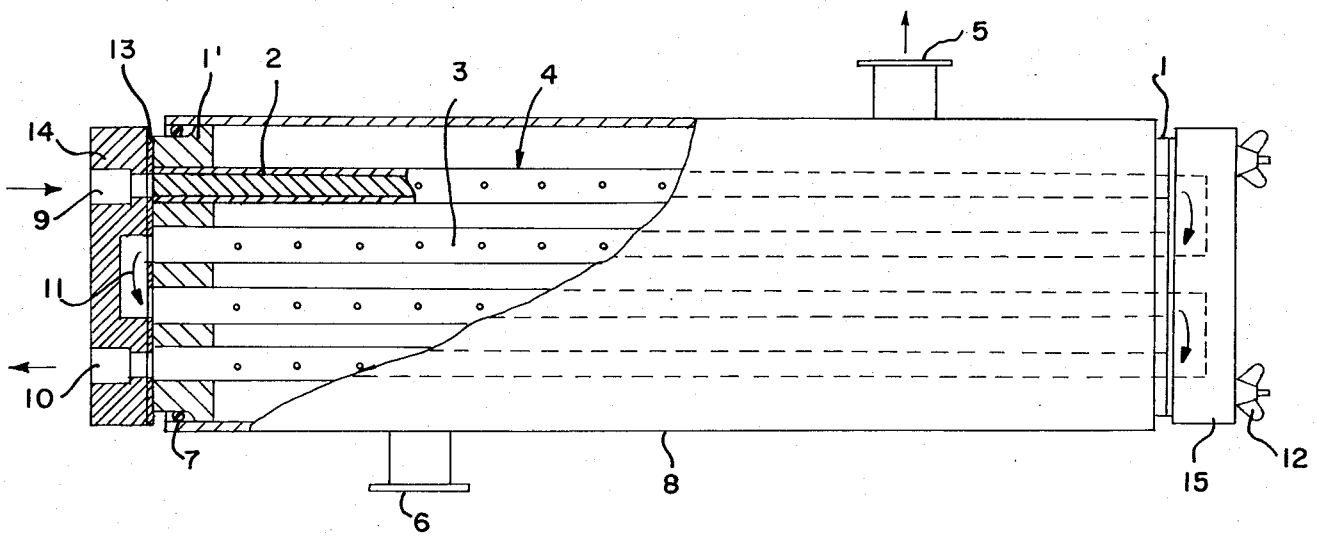
1
1'
2
3
4
5
6
7
8
9
10
11
12
13
14
15

METHOD FOR TREATING THE SURFACE OF STAINLESS STEEL BY HIGH TEMPERATURE OXIDATION

FIELD AND BACKGROUND OF THE INVENTION

This invention relates to a method for treating the surface of stainless steel by high temperature oxidation.

Conventionally there has been a "metal coloring" method that allows an oxide film formed on the surface of various metals, such as aluminum, titanium or stainless steel, etc., to develop color by utilizing the phenomenon of light interference. Since this method can produce various color tones by controlling the thickness of oxide film without destroying the native brightness of the base metal, the method has been widely used on ornamental or construction materials.

The conventional methods for metal coloring comprise:

(I) Dipping metallic material in chemical reagents (II) Anodically oxidizing in chemical reagents (III) Oxidizing at elevated temperatures in an oxidizing atmosphere (refer to Japanese Laid Open Pat. Appl. Nos. 48-99047, 49-58035 & 52-134833)

Regarding (I) above, since the color tone of an oxide film varies delicately depending on the composition of the reagent and on the dipping time (the color changes with every second and every minute), the color development requires a fine control against degradation of reagents.

As to (II) above, inhomogeneities in the electric current density, or generation of oxygen gas can cause an unevenness in the coloring. Therefore, the applying material is limited to metal having simple configurations such as plates or sheets.

Colored oxide films obtained by the methods (I) (II) are subject to corrosion or abrasion because of their high porosity, and the film requires a hardening treatment after each coloring.

In method (III) above, the method is widely used for coloring materials such as stainless steels or titanium alloys having high temperature strength, because the method is easy to practice and can give a solid colored oxide film. While this method can form a colored oxide film having the tone corresponding to the heating temperature of the applying metal, it has a drawback in that it causes an unevenness or shades in color, resulting in an aggravated appearance, because the degree of oxidation differs depending on the location of matallic surface. Therefore, the use of this method has been limited to the blackening treatment of heat exchanger tubes or to small parts that require no concern for the sense of beauty.

In the food or pharmaceutical industry, the stainless steel is often used for equipment or integral parts of a factory, such as storage tanks, pipes or valves. The corrosion resistance of stainless steel is maintained, in general, by a passive film of Fe-, Cr-, Ni-oxide. However, because the thickness of the coating of only several Å or tens of Å, the dissolution of Fe-ions cannot be avoided.

For example, in the brewing industry, sake, wine, beer, etc. contain various kinds of organic acids. In particular, in the inner or outer surface of a storage tank, ultrafiltration equipment or pipes are treated by buffing or pickling to prevent the adherence of germs or sal tartar and to improve their cleanliness. For example, the surface of ultrafiltration equipment is treated with a No. 400 mirror finish, because of the dissolution of iron into sake and the sanitary requirements of the equipment. However, when sake is stored for longer than 10 hours, iron can dissolve from the stainless steel surface into the sake, making the sake colored and lowering its commercial value from the viewpoint of its taste. Accordingly, nowadays materials for piping in such plants or the module of ultrafiltration equipment, include plastic or plastics-lined materials which are immune to the dissolution of iron.

In the pure chemical field, or the field that requires clean water such as nuclear power station or electronics industry, there are many processes that require a solution to be free from the dissolved Fe-ions.

Corrosion-resistant stainless steel is expected to increase the corrosion resistance because of a coloring process, but in practice such coloring can deteriorate the resistance, depending upon the treatment process. (Refer to Table 4 herein.) Accordingly, the coloring process can leave some problems for uses where high corrosion-resistance is required.

The reason for the deterioration of corrosion resistance seems to be due to the fact that the oxide film formed by the heat-treatment after the mechanical abrasion is not so dense nor uniform that the base-metal cannot be subjected to crevice corrosion or pitting corrosion.

One solution for this problem is to dip a stainless steel article having a colored oxide film formed by the high temperature oxidation, in a nitric acid solution to passivate the base metal at the defective location of the film. This process helps to prevent the corrosion resistance from becoming deteriorated to some extent, but this process has the danger of causing the dissolution of the colored oxide film resulting in a change of color tone.

It is a general object of this invention to solve the problems in the known prior art, and more specifically to provide a treatment method for forming a colored oxide film on a stainless steel surface, particularly by the use of high temperature oxidation that allows the film to have a better color and more beautiful tone with no unevenness and shades, as well as to have an improved corrosion resistance.

Furthermore, since the oxide film formed under the present high temperature oxidation treatment comprises stationary oxides of Fe, Cr, Ni having hundreds ofÅ in thickness, the dissolution of metallic ions from the stainless steel becomes less than that from conventional oxide films. However, in the field of use where extremely strict conditions are required, the prevention from some dissolution might be unsuccessful.

Accordingly, the further object of the present invention is to prevent the dissolution from stainless steel of Fe-ions by a drastic improvement of the prior art.

BRIEF SUMMARY OF THE INVENTION

In the method in accordance with the present invention, first, the surface of a stainless steel article to be colored is electrolytically polished to improve the characteristics of the polished surface of the base metal suitably for the subsequent formation of the oxide film. Then the article is subjected to a heat-treatment in an oxidizing atmosphere and keeping the temperature and time corresponding to the color tone to be colored.

The process of the present invention is summarized in further detail as follows:

(1) The surface of the stainless steel article to be colored is cleaned by a traditional process, for example, by pickling, buffing and degreasing to remove oxides or impurities on the surface, and then polished completely by electrolytic polishing.

(2) Before the heat-treatment is performed, if necessary, the surface is treated with a coating agent consisting of high-melting-point microparticles.

(a) The coating agent is composed of materials that do not melt even under the high temperatureheating of this method. As a suitable coating agent powders of $TiO_2$ and $SiO_2$ are mixed in a ratio between 100:0 and 25:75 in weight and the mixture is pulverized with a crusher such as a ball mill, etc. and graded by a 150-mesh sieve to achieve a small particle size, and water is added to the small-sized microparticles and to make a slip. The grade or size adjustment is performed accurately; if the slip contains some coarse particles, the oxidation film becomes uneven at locations where coarse particles contact with the metallic surface and form a speckled oxide film during the heat treatment. It has been experimentally confirmed that when the particles are adjusted to sizes smaller than 150-mesh, a slip consisting of such particles causes no unevenness in color.

(b) Placing the coating agent on the exposed metal surface, after the cleaning treatment, is performed by spattering, pouring the slip or dipping the object in the slip or sprinkling the dried coating agent, etc. Among the above methods, spraying the slip is advantageous for the preadjusted slip because it gives a uniform thickness of the coating, like spraying enamel on a glass lining. One optional component of the coating material is $SiO_2$ which can improve the spraying property of the slip. However, with increasing mixing ratio of $SiO_2$, the adhesive strength of the dried coating decreases; accordingly, the mixing ratio of $SiO_2$ is preferably kept under 75%. It is important to coat in such a manner that the coating has a uniformly distributed thickness after completion of the coating.

When the thickness of the coating differs depending on the coated location, the difference in the oxidation speed generates shades of color of the tone of the formed oxide film. Preferrable thickness of the slip coating is 0.1 to 1 mm. When the thickness is too thin, unevenness in the oxidation grade easily causes irregularities and shades in color, whereas when it is too thick, irregularities in color vanish but the oxidation speed decreases, leading to a longer time required for the heat-treatment.

(c) The pasted membrane or coating is dried completely.

(3) The heat-treatment is performed to form the oxide film. This treatment is performed in an oxidizing atmosphere at the temperature and for the time corresponding to the color tone to be colored. The preferred temperature for the heat-treatment is 350° to 700° C. At temperatures lower than 350° C., formation of the oxide film becomes incomplete. At temperatures higher than 700° C. (heat-resisting temperature of stainless steel being assumed to be 800° C.), the oxide film becomes too thick and results in it being too brittle. Stainless steel causes precipitation of chrome-carbide at temperatures between 450° and 750° C. depending on the type, leading to a danger of causing the pitting corrosion or stress-corrosion cracking. Therefore, when the equipment or apparatus is to be used under severe corrosive conditions, it is recommended that the temperature for the heat-treatment be limited to lower than 450° C.

At each heating-temperature, the growth of thickness of the oxide film is retarded with the lapse of heating time. Since the heating time differs depending on each applying condition, it is recommended to determine a desirable heating time matched to a stable thickness of the film, in accordance with the result of an experiment performed with some test pieces to become familiar with the formation behavior of the oxide film.

These heating temperatures and times are to be determined by considering the types of steel, the presence or absence of the coating agent, the behavior of the coating and by cross-referring the embodied example as will be described later, accumulated data along with pretrials. Since the oxide film is formed under the coating of the coating agent, it cannot be distinguished visually.

(4) When the coating agent is used, it is removed by washing or other means after cooling.

(5) When the surface of stainless steel having lesser dissolution of iron is required, the decolorizing treatment is performed, that is, the colored oxide film is dissolved and removed as by acid or by the electrolytic treatment.

Though each step described above is mutually independent, a preceding step affects closely a following step. For example, practicing the cleaning treatment of the first step with an electrolytic polishing will affect the last process profitably. And at the second step, a uniform pasting of the coating agent consisting of microparticles having high melting points, followed by the high temperature heating will serve to practice the third step thereby preventing a possible adverse result.

BRIEF DESCRIPTION OF THE DRAWINGS

As one example of the use of an embodiment of this invention, the single FIGURE of the attached drawing shows a vertically cross-sectioned side view of ultrafiltration equipment made of stainless steel used for brewing sake.

DETAILED DESCRIPTION OF THE INVENTION

The thickness and density of the colored oxide film can be changed by adjusting the temperature and time of the heat-treatment, and the color tone of the film can be identified by the type of metal. The electrolytic polishing is physically different from mechanical polishing and since the electrolytic polishing is a type of chemical polishing, the surface of the stainless steel subjected to the electrolytic polishing reveals some characteristic chemical change. When a desirable colored film is formed on the electrolytically polished stainless steel article by keeping it at a predetermined temperature and for a predetermined time in the oxidizing atmosphere, the film is more dense, has a better appearance and has a more corrosion-resistance property as compared with an oxide film formed under similar conditions after a mechanical polishing. The reason seems to be due to the fact that metallic components of the stainless steel surface are changed by the electrolytic polishing, and it is assumed, correctly it is believed, that the chrome content has been condensed to 1.5 to 2 times compared with the content before the polishing. Since chrome has more corrosion resistance than iron, the surface condensed to increase the chrome content seems to have improved corrosion resistance.

On the other hand, when the surface of stainless steel is heat-treated according to the conventional art without a layer of the coating agent, the surface has a color unevenness due to the difference in oxidation gradation, and decreases the beauty of the surface. Contrary to the conventional art, in the method of the present invention, since the coating agent including $TiO_2$, $SiO_2$ is applied uniformly and is subjected to the heat-treatment, the colored oxide film is formed uniformly with no color unevenness or shading. The relatively long period of the heat-treatment makes the operation easier and serves to produce a stable result.

The colored oxide film formed by heat-treating the stainless steel in the oxidizing atmosphere appears to consist of $Fe_2O_3$, $Cr_2O_3$, NiO and chemicals combined with them. Because the oxidation speed among Fe, Cr and Ni is different from each other, it is assumed that in the colored oxide film the relative amount or content of the Fe component becomes larger, whereas at the interface between the colored oxide film and the lower base metal the relative contents of components Cr and Ni become larger and the content of Fe becomes relatively less. Accordingly, by removing the colored oxide film having more Fe on its surface, the interface having more Cr and Ni components is exposed. This exposed surface seems to react effectively to decrease the amount of dissolved Fe-ions into the contacting liquid during use.

According to an experiment on SUS 304, the color of the colored oxide film formed by the heat-treatment of the above third process depends on the temperature of the heat-treatment; for example, a heating temperature of 350° to 400° C. causes a golden color, a temperature of 500° C produces a red color and 800° C. causes a blue color. On the contrary, the decolorized surface of stainless steel subjected to the fifth process of this invention at the heat temperature of 500° C. maintains the original metal brightness with no change in color, at 600° it becomes a light golden color and at 800° it begins to bear a light blue color. These phenomena certify that the composition of the stainless steel surface subjected to the fifth process of this invention differs from that of the original stainless steel, and support the theory that the Fe component has been decreased while the Cr, Ni components have been increased.

When the electrolytic polishing is applied at the first step of the cleaning treatment, Fe dissolutes selectively leaving Cr more concentrically, so that the first process allows the dissolution of Fe-ions from the stainless surface following the fifth step to decrease more drastically. Further, since practicing the second step with the heat-treatment by use of the coating agent enables the colored oxide film to form a uniform thickness, the decolorizing treatment of the fifth step can be carried out smoothly, without producing unevenness.

In general, the passive film formed on the surface of stainless steel comprises oxides of Fe, Cr, Ni (in the form of $Fe^{+++}$, $Cr^{+++}$, $Ni^{+++}$) having several Å in thickness.

On the other hand, the film formed by the method of the present invention seems to comprise $(CrFe)_2O_3 \cdot (FeNi)O \cdot \times H_2O$ having 300 to 500 Å in thickness and a stable state. As a result it is presumed that the amount of iron being dissolved from the surface of the stainless steel as ions of $Fe^{++}$or $Fe^{+++}$, is very small.

Though the mechanism of dissolution of Fe into the liquid in equipment or apparatus during use is not known accurately, the result of one experiment using test pieces is given as follows, compared with the result when using the prior art methods of buffing and pickling.

The material used in the test was SUS 304.

Test conditions—with sake, normal temp., 20 hr. dip

| Type of surface treatment | Fe dissolution in liquid (ppm) |
|---|---|
| Buffing | 0.210–0.250 |
| Pickling | 0.140–0.220 |
| This invention (electroly. polish + high temp. oxidation) | 0.015–0.019 |

In the above table, the dissolution amount of Fe is equal to the measured amount minus the Fe concentration inherently included in sake. Amount of liquid per contact area in $cm^2$ with the test pieces was taken as 0.16 ml.

EXAMPLE 1

(1) The surface of SUS 304 stainless steel pipe and SUS 316 stainless steel sheet were first buffed and then degreased with keton or alcohol. Equal amounts of $TiO_2$ and $SiO_2$ were mixed together, pulverized to form particles less than 150-mesh and dispersed in water to form a slip. The slip was applied on the surface of the steel pieces by spraying to make a uniform coating having about 0.2 mm in thickness. After drying of the coating, heat-treating the coating in a heating furnace under conditions as described in Table 1 produced various kinds of colored oxide film having various tones without color unevenness or shades, as set out in Table 1.

TABLE 1

| SUS 304 pipe | | | SUS 316 sheet | | |
|---|---|---|---|---|---|
| heating temp. (°C.) | time (min.) | tone | heating temp. (°C.) | time (min.) | tone |
| 400 | 30 | golden | 400 | 30 | golden |
| 450 | 30 | light red | 550 | 30 | red |
| 800 | 30 | dark gray | 800 | 30 | blue |

In case of stainless steel, the color of the oxide film varies with the heating temperature. With increasing time, the color concentration increases and remains stable after 30 minutes.

EXAMPLE 2

As test pieces of stainless steel articles, pipes having 1 inch in diameter and sheets having the dimension of 30 mm×40 mm×1 mm, of SUS 304 and SUS 316, were used.

The treating method according to this invention was as follows:

The surface of the stainless steel test pieces to be colored was buffed to remove solid foreign substances from the surface, degreased by keton or alcohol, followed by the electrolytic polishing. The polishing was performed by using an acidic electrolyte under conditions of current density of 5 to 30A/$dm^2$ and an energizing time of 15 min.

Then the test-pieces were made completely free from the electrolyte by washing them, and then dried and placed in a heating furnace to be subjected to the heat-treatment under the conditions described in Table 2 to form the colored oxide film. The color tone is described in the Table.

TABLE 2

| SUS 304 pipe | | | SUS 316 pipe | | |
|---|---|---|---|---|---|
| temp. (°C.) | time (min.) | tone | temp. (°C.) | time (min.) | tone |
| 400 | 30 | golden | 400 | 30 | golden |
| 450 | 30 | light red | 550 | 30 | red |
| 800 | 30 | dark gray | 800 | 30 | blue |

Because they had a small surface area, the test pieces for the above corrosion test were heat-treated without a coating. However, by performing the high temperature heating step after the surface cleaning, the test-pieces exhibited the colored oxide film having the same tones as those in Table 1 without causing color unevenness or shades.

Test pieces having the same dimensions as described in the foregoing example were subjected to a corrosion test to compare them with the test pieces treated by the prior art. The results are shown hereunder.

(1) SUS 304 stainless steel

A corroding solution having PH3 was formed by adding 1 cc of 85% lactic acid to 3 1. pure water treated by ion-exchange. Each test piece was dipped in 250 cc solution for 48 hrs. at 50° C. The result is shown in Table 3.

TABLE 3

| Specification | Fe dissolution (ppm) |
|---|---|
| (prior art) polish (#600) + high temp. oxidation (450° C., 30 min.) | 0.81 |
| (prior art) polish (#600) + high temp. oxidation (450° C., 30 min.) + passivation (1N—$HNO_3$, 30 min.) | 0.11 |
| (this invention electrolyt. polish + high temp. oxidation (450° C., 30 min.) | 0.017 |

(2) SUS 316 Stainless Steel

Each test piece was dipped in 180 cc of pure water deaerated with nitrogen gas for 250 hr. The result is shown in Table 4.

TABLE 4

| Specification | Weight loss (g/m$^2$) |
|---|---|
| (prior art) #320 buff finish | 0.825 |
| (prior art) #320 buff finish + high temp. oxidation (375° C., 30 min.) | 1.605 |
| (prior art) #320 buff finish + electrolyt. polish | 0.130 |
| (this invention) #320 buff finish + electrolyt. polish + high temp. oxidation (375°, 30 min.) | 0.050 |

EXAMPLE 3

Test pieces made of SUS 304 stainless steel were subjected to the treatment according to this invention, and similar pieces to various treatments according to the prior art, to compare their corrosion resistance. The results are shown as follows:

Test (I)

| Treatment conditions | |
|---|---|
| Sample 1 | mechanical polishing with #600 |
| Sample 2 | only electrolytic polishing |
| Sample 3 | electrolytic polishing and heat-treatment at 450° C. for 30 min. |

-continued

| Treatment conditions | |
|---|---|
| Sample 4 | (this invention) mechanical polishing with #600, heat-treatment at 450° C. for 30 min., and oxide film removed with 1N—HCl. |
| Sample 5 | (this invention) electrolytic polishing, heat-treatment at 450° C. for 30 min. and oxide film removed with 1N—HCl. |

Corrosion Test Conditions

A corrosive solution having PH3 was formed by adding 1 cc of 85 % lactic acid to 3 l. pure water treated by ion-exchange. Each test piece having the dimension 30 mm×40 mm×1 mm was dipped in 250 cc of the solution for 48 hrs. at 50° C. Test result The amount of dissolved Fe-ion and Cr-, Ni-ion in the solution is shown in Table 5.

TABLE 5

| Sample No. | Fe—ion dissolution (ppm) | Cr, Ni—ion dissolution (ppm) |
|---|---|---|
| 1 | 0.10 | <0.01 |
| 2 | 0.08 | <0.01 |
| 3 | 0.02 | <0.01 |
| 4 | 0.02 | <0.01 |
| 5 | <0.01 | <0.01 |

Test (II)

| Treatment conditions | |
|---|---|
| Sample 6 | electrolytic polishing, heat-treated at 450° for 30 min. |
| Sample 7 | (this invention) electrolytic polishing, heat-treated at 450° C. for 30 min., oxide film removed with 1N—HCl. |

Corrosion Test Conditions

Test pieces having the same dimensions as for Test (1) were dipped in 250 cc of a 0.1 wt % sulfuric acid solution at 50° C. for 96 hrs. Test result The amount of dissoluted Fe-ion and Cr, Ni-ion in the solution is shown in Table 6.

TABLE 6

| Sample | Fe—ion dissolution (ppm) | Cr,Ni—ion dissolution (ppm) |
|---|---|---|
| 6 | 0.10 | <0.01 |
| 7 | 0.02 | <0.01 |

The decolorizing treatment of the oxide film differs depending on each applying condition, such as the thickness of the oxide film, the type of acid, the concentration and temperature of the acid, etc. Therefore, before industrial use, it is desirable to determine each condition by means of the result of an experiment performed in use on some test-pieces, to become familiar with the decolorizing behavior. The behavior of removing the oxide film can be confirmed visually by the experiment. The above examples are the results of such experiments.

The surface treatment in accordance with this invention of various kinds of typical integral parts of brewery equipment or apparatus made of the stainless steel are described as follows:

(I) Examples of Simple Configurations (I-1) Tanks

The surface of a stainless steel tank was cleaned by the electrolytic polishing method. A coating agent of $SiO_2$ mixed with $TiO_2$ in a weight ratio 0 to 25% was formed and the mixture was sieved and processed so that all particles were passed through a 150-mesh sieve. This mixture was used as the coating agent which, after mixing with water, was coated on the surface of the metal so that the coating had a uniform thickness between 0.1 to 0.2 mm. Then the coating was dried and heated at a predetermined temperature between 350° to 450° C. in an oxidizing atmosphere to form the oxide film.

After cooling to room temperature the coating agent was washed away and removed. Afterwards, if necessary, the removing treatment for the oxide film may be performed.

(I-2) Pipes

The inner surfaces of stainless steel pipes were cleaned by electrolytic polishing and the coating agent described above was coated on the surfaces by spraying or casting. Then the coating was dried and heat-treated to form the film under similar conditions as described above. Next the coating agent was removed by washing. Afterwards, if necessary, the oxide film is eliminated.

(II) Example for Surface-treating of Brewery Equipment Having a Complex Configuration The operation process is described hereafter by taking the stainless steel ultrafiltration equipment for brewing sake as an example. With reference to the drawing, this equipment comprises an integrated module which has perforated pipes connected at each end with pipe plates or headers 1 by welding, for receiving the ultrafiltration membrane 2 therein after completion according to the process of this invention, the structure further including an outlet 5 for filtrated liquid and a outlet 6. In addition, equipment comprises at the circumference of the plates 1, a shell 8 sealed with the mating O-rings 7, a liquid inlet 9, an outlet 10 for concentrated liquid, inter-pipe connecting ducts 11, a terminal flange 14 attached to the outer surface of the plate 1 through packing 13 by means of fixing screws 12 and a blind flange 15.

To practice the method of this invention, the surfaces of module 4 were first cleaned with a cleaner to remove dirt and then cleaned by electrolytic polishing. The module (minus the shell 8 and the flanges 14 and 15) was dipped in a large vessel containing the coating agent to cause the agent to adhere to the inner and outer surfaces of the perforated pipes 3 and pipe plates 1. The module was taken out of the dipping vessel and mounted on a rotary apparatus and rotated so as to make the thickness of the coating layer uniform. The outer surfaces of the pipe plates 1 could otherwise be coated by spraying. Then the coating layer on the module was dried by hot air movement in a rotary furnace, in order to prepare the module for the following process.

Meanwhile, since only the inner surface of the shell 8 will contact the alcoholic beverage during use, the coating agent is applied to the inner surface and made iniform in thickness, after adhesion and upon cleaning the shell by electrolytic polishing, by subjecting the shell to rotation on the rotary apparatus in the same way as the module 4.

Since only the inner surfaces of the terminal flanges 14 and 15 serve as contacting surfaces with the sake, the contacting surfaces are cleaned by electrolytic polishing and the coating agent is coated uniformly by spraying and dried in a dryer or at room temperature.

The module 4, shell 8, terminal flanges 14 and 15 are prepared as described above and are heated in a heat-treating furnace. They were maintained for 30 min. at the predetermined temperature between 375° C. and 450° to form the oxide film.

Afterwards they were cooled and cleaned with high pressure water to eliminate the coating agent and then dried.

On the surface of the SUS 316 and SUS 304 stainless steel integral parts were subjected as above to the oxidation treatment, the oxide film with a golden color was formed.

Next the module 4, shell 8 and terminal flanges 14 and 15 were assembled with the ultrafiltration equipment, and sake was passed through it at the rate of 0.2 cc/min. per unit of oxide area ($cm^2$). The iron content dissolved from the oxide surface was about 0.01 to 0.02 ppm. Sake containing iron more than 0.1 ppm bears a reddish color which diminishes its commercial value. The above example of this invention proves that such deterioration can be avoided substantially completely.

On the other hand, in the case of equipment subjected to no oxidation treatment as is true of this invention, the iron content was 0.14 to 0.25 ppm, which reveals the deterioration of the commercial value of the product.

Advantages of the method of this invention are summarized as follows.

(a) In the prior art coloring the metal surface with the high temperature oxidation treatment causes color unevenness or shades and lowered the value of the colored product, whereas the method according to the present invention produces a uniform and beautiful coloring with no unevenness. Further, compared with the coloring method of the prior art accompanying the reagent treatment, the method of the present invention provides the colored product with an improved corrosion resistance; preventing the color tone from an abrupt change makes the color-developing control easier by being able to adjust the heating temperature and time, and makes its reproducibility better.

(b) By practicing the high temperature oxidation coloring of this invention through the use of a heating furnace capable of good temperature control, metals having complex configurations or large numbers can be treated in quantities at a time. Thus the method of this invention provides the advantages of enlarging the scope of use as well as of mass-producing beautiful pieces at a reduced cost.

(c) The coloring treatment of the prior art is followed by a passivation treatment with nitric acid for improving the corrosion resistance. This invention eliminates the latter treatment.

(d) Further, since the method of this invention reduces the dissolution of Fe-ion to very little, the equipment and pipes used for pharmaceuticals or in the food industries, which require high corrosion resistant alloys or nonmetallic materials such as glass linings, can be replaced with ordinary stainless steels.

Wherever a reference is made herein to heating an article in an oxidizing atmosphere, the ambient air present in a heating oven serves as the oxidizing atmosphere.

As described above, the method of the present invention produces a substantial number of important advantages.

What is claimed is:

1. Method for treating a stainless steel surface to provide a uniform colored oxidation film thereon by high temperature treatment, comprising the steps of cleaning which includes electrolytically polishing the stainless steel surface to be treated, applying a substantially uniform thickness of a coating agent on said surface, said agent consisting of microparticles having a high melting point, said surface being subjected to a high temperature heat-treatment in an oxidizing atmosphere, keeping the temperature and the length of time corresponding to a color tone for a formed colored oxide film on said stainless steel surface, and then washing away said coating agent after cooling.

2. Method for treating the stainless steel surface as set out in claim 1, wherein said coating agent comprises $TiO_2$, and $SiO_2$ mixed in a weight ratio between 100:0 and 25:75, and the mixture being sieved and adjusted so that all particles are passed through a 150-mesh sieve followed by the addition of water to form a slip which is applied as said coating which has a uniform thickness between 0.1 to 1 mm.

* * * * *